US005929022A

United States Patent [19]

Velazquez

[11] Patent Number: 5,929,022

[45] Date of Patent: Jul. 27, 1999

[54] DETERGENT COMPOSITIONS CONTAINING AMINE AND SPECIALLY SELECTED PERFUMES

[75] Inventor: Jose Maria Velazquez, Col. Lomas de Chapultepec, Mexico

[73] Assignee: The Procter & Gamble Company, Cincinnati, Ohio

[21] Appl. No.: 09/011,237

[22] PCT Filed: Aug. 1, 1996

[86] PCT No.: PCT/US96/12611

§ 371 Date: Feb. 5, 1998

§ 102(e) Date: Feb. 5, 1998

[87] PCT Pub. No.: WO97/06235

PCT Pub. Date: Feb. 20, 1997

[51] Int. Cl.[6] ..... C11D 3/30; C11D 3/50; C11D 1/94

[52] U.S. Cl. ..... 510/499; 510/101; 510/102; 510/103; 510/104; 510/340; 510/341; 510/352; 510/332; 510/327; 510/433

[58] Field of Search ..... 510/101, 102, 510/103, 104, 499, 340, 341, 352, 332, 327, 433

[56] References Cited

U.S. PATENT DOCUMENTS 5,500,154 3/1996 Bacon et al. ..... 252/551

FOREIGN PATENT DOCUMENTS 147191 3/1985 European Pat. Off. ..... C11D 3/50
WO 94/22999 10/1994 WIPO ..... C11D 3/00

*Primary Examiner*—Yogendra N. Gupta
*Assistant Examiner*—Charles Boyer
*Attorney, Agent, or Firm*—Ian S. Robinson; Kim William Zerby; Jacobus C. Rasser

[57] ABSTRACT

Laundry detergent compositions containing amine detersive surfactants and specifically selected perfume components which reduce the malodor of the amine are provided.

7 Claims, No Drawings

DETERGENT COMPOSITIONS CONTAINING AMINE AND SPECIALLY SELECTED PERFUMES

TECHNICAL FIELD

This invention relates to laundry detergent compositions containing amine detersive surfactants and specially selected perfume components which reduce the malodor of the amine.

BACKGROUND OF THE INVENTION

It has long been known that certain amines are effective detergent surfactants. However, a problem associated with many amines is an unattractive odor resembling fish which remains present in detergent compositions containing the amine and even in fabrics which have been washed with the amine-containing detergent.

It has now been found that including a certain amount of specially selected perfume components in the laundry detergent can markedly reduce or eliminate this malodor.

SUMMARY OF THE INVENTION

The present invention concerns laundry detergent compositions comprising:

(a) from about 0.05% to about 10%, by weight of detergent composition of an amine detersive surfactant;

(b) from about 0.00001% to about 5%, by weight of the composition, of a perfume component selected to have the following characteristics:

i) a partition coefficient value (clogP) equal to or higher than 2.0;

ii) a boiling point greater than 200° F.; and iii) a low odor detection threshold (ODT) lower than about 300 PPB; and (c) from about 1 to about 95%, by weight of the composition, of other non-amine detersive surfactants selected from anionic, nonionic, ampholytic, cationic, zwitterionic, and mixtures thereof.

These perfume components act to reduce the malodor associated with amine surfactants. Preferably the perfume components is selected from the group consisting of dodecahydro-3*a*,6,6,9A-tetramethylnaphtho (2,1-B) furan, 3,3-dimethyl-5-(2,2,3 trimethyl-3 cyclopenten-1-yl)-4 pentenol, methyl ionone, cis 3 hexenyl iso butyrate, undecalatone, phenyl ethyl phenyl acetate, hexyl-ortho-hydroxbenzoate, and mixtures thereof; and The compositions of this invention preferably further comprise a performance enhancing amount of a detergent-compatible enzyme selected from the group consisting of protease, lipase, amylase, cellulase, peroxidase, and mixtures thereof.

All parts, percentages and ratios used herein are expressed as percent weight unless otherwise specified. All documents cited are, in relevant part, incorporated herein by reference.

DESCRIPTION OF THE INVENTION

The laundry detergent compositions herein comprise an effective amount of a perfume component which acts to reduce the malodor associated with the amine surfactant. By "effective amount" means an amount sufficient to reduce the amine-type odor of the detergent compositions. Preferably, the detergent compositions herein will comprise from about 0.00001% to about 5, more preferably about 0.00001% to about 2%, most preferably about 0.0001% to about 0.5%, by weight, of specially selected perfume components. The perfume components which have been found to reduce the amine malodor are those with a low solubility in water, i.e., they have a partition coefficient value, (clogP), equal to or higher than 2.0, at standard conditions of 25° C. and 760 mm Hg in a water/octanol system. Additionally the perfume components of this invention should have a boiling point greater than 200° F. The perfume components also have a unique property of having a low odor detection threshold (ODT) lower than about 300 PPB, preferably equal to or lower than about 0.1 PPB. These parameters are fully explained in "Compilation of Odor and Taste Threshold Value Data. (ASTM DS 48 A)". Edited by F. A. Fazzalari, International Business Machines, Hopewell Juntion, N.Y.

Examples of preferred perfume components are those selected from the group consisting of dodecahydro-3*a*,6,6,9A-tetramethylnaphtho (2,1-B) furan, 3,3-dimethyl-5-(2,2,3 trimethyl-3 cyclopenten-1-yl)-4 pentenol methyl ionone, cis 3 hexenyl iso butyrate, undecalatone, phenyl ethyl phenyl acetate, hexyl-ortho-hydroxybenzoate, and mixtures thereof.

It is preferred that the specially selected perfume components herein be mixed together prior to addition to the laundry detergent composition. These perfume components may be combined with other perfume ingredients before addition to the composition.

The perfume containing these specially selected perfume components is preferably sprayed onto the final granular detergent composition or mixed into the final liquid laundry detergent in a manner which does not adversely affect the perfume.

The amine—Although certain amines are effective surfactants, when present in sufficient amounts, many posses an unattractive amine-type malodor which makes them undesirable for laundry applications. Amines suitable for use in the detergent compositions herein include those according to the formula:

$$R_1—X—(CH_2)_n—N(R_3)(R_4)$$

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2CH(OH)R_5$) wherein $R_5$ is H or methyl.

Preferred amines include the following:

$$R_1—(CH_2)_2—NH_2$$

$$R_1—O—(CH_2)_3—NH_2$$

$$R_1—C(O)—NH—(CH_2)_3—N(CH_3)_2$$

$$R_1—N(CH_2—CH(OH)—R_5)_2$$

wherein $R_1$ is a $C_6$–$C_{12}$ alkyl group and $R_5$ is H or $CH_3$.

In a highly preferred embodiment, the amine is described by the formula:

$$R_1—C(O)—NH—(CH_2)_3—N(CH_3)_2$$

wherein $R_1$ is $C_8$–$C_{12}$ alkyl.

Particularly preferred amines include those selected from the group consisting of octyl amine, hexyl amine, decyl amine, dodecyl amine, $C_8$–$C_{12}$ bis(hydroxyethyl)amine, $C_8$–$C_{12}$ bis(hydroxyisopropyl)amine, and $C_8$–$C_{12}$ amidopropyl dimethyl amine, and mixtures.

The laundry detergent compositions of the present invention typically comprise from about 0.5% to about 10%, preferably from about 1% to about 5%, by weight of amine surfactants.

Non-Amine Detergent Surfactants—A wide range of non-amine, secondary surfactants can be used in the detergent composition of the present invention. By "non-amine" is meant herein any detersive surfactant which does not have the unattractive "amine" malodor associated with its use in a detergent composition. Included in this definition of non-amine, therefor, is amine oxides which do not have an amine-type odor.

A typical listing of anionic, nonionic, ampholytic and zwitterionic classes, and species of these surfactants, is given in U.S. Pat. No. 3,664,961 issued to Norris on May 23, 1972. The laundry detergent compositions of the present invention typically comprise from about 1% to about 95%, preferably from about 3% to about 40%, more preferably from about 5% to about 25%, by weight of such secondary, non-amine surfactants.

One class of preferred anionic surfactants to be used in this invention are the alkyl alkoxylated sulfate surfactants which are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include ethanol-, triethanol-, methyl-, dimethyl, trimethyl-ammonium cations and quaternary ammonium cations such as tetramethyl-ammonium and dimethyl piperidinium cations and those derived from alkylamines such as ethylamine, diethylamine, triethylamine, mixtures thereof and the like. Exemplary surfactants are $C_{12}$–$C_{15}$ alkyl polyethoxylate (1.0) sulfate ($C_{12}$–$C_{15}$E(1.0)M), $C_{12}$–$C_{15}$ alkyl polyethoxylate (2.25) sulfate ($C_{12}$–$C_{15}$E(2.25)M), $C_{12}$–$C_{15}$ alkyl polyethoxylate (3.0) sulfate ($C_{12}$–$C_{15}$E(3.0)M), and $C_{12}$–$C_{15}$ alkyl polyethoxylate (4.0) sulfate ($C_{12}$–$C_{15}$E(4.0)M), wherein M is conveniently selected from sodium and potassium.

Another useful and preferred class of anionic surfactants are the alkyl sulfate surfactants. Especially preferred are the alkyl sulfates which are water soluble salts or acids of the formula $ROSO_3M$ wherein R preferably is a $C_8$–$C_{18}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperidinium cations and quaternary ammonium cations derived from alkylamines such as ethylamine, diethylamine, triethylamine, and mixtures thereof, and the like).

Other suitable anionic surfactants that can be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

$$R^3—CH(SO_3M)—C(O)—OR^4$$

wherein $R^3$ is a $C_8$–$C_{20}$ hydrocarbyl, preferably an alkyl or combination thereof $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkypolyglycolethersulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$—M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol particularly the $C_{12}$–$C_{15}$ primary alcohols containing 5–8 moles of ethylene oxide per mole of alcohol.

Another class of nonionic surfactants comprises alkyl polyglucoside compounds of general formula $$RO—(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chin alkyl polyglucosides. Compounds of this type and their use in detergent are disclosed in EP-B 0 070 077, 0 075 996 and 0 094 118.

Very suitable as nonionic surfactants are poly hydroxy fatty acid amide surfactants of the formula $$R^2—C(O)—N(R^1)—Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Highly preferred nonionics are amine oxide surfactants. The compositions of the present invention may comprise amine oxide in accordance with the general formula I:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R^1$ =$C_8$–$C_{18}$, R'=H and q=0–2, preferably 2. These amine oxides are illustrated by $C_{12-14}$ alkyldimethyl amine oxide, hexadecyl dimethylamine oxide, octadcylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp.

Preferred embodiments include hexadecyldimethylamine oxide dihydrate, octadecyldimethylamine oxide dihydrate, hexadecyltris(ethyleneoxy)dimethyl-amine oxide, and tetradecyldimethylamine oxide dihydrate.

Whereas in certain of the preferred embodiments R'=H, there is some latitude with respect to having R' slightly larger than H. Specifically, the invention further encompasses embodiments wherein R'=$CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixture thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred cationic surfactants are the water-soluble quaternary ammonium compounds useful in the present composition having the formula:

$$R_1R_2R_3R_4N^+X^- \quad (i)$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_40)_xH$ where x has a value from 1 to 5, and X is an anion. Not more than one of $R_2$, $R_3$ or $R^4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12-15}$ dimethyl hydroxyethyl ammonium chloride or bromide;
- coconut dimethyl hydroxyethyl ammonium chloride or bromide;
- myristyl trimethyl ammonium methyl sulphate;
- lauryl dimethyl benzyl ammonium chloride or bromide;
- lauryl dimethyl (ethenoxy)$_4$ ammonium chloride or bromide;

choline esters (compounds of formula (i) wherein $R_1$ is —$CH_2$—O—C(O)—$C_{12-14}$ alkyl and $R_2R_3R_4$ are methyl).

Other cationic surfactants useful herein are also described in U.S. Pat. No. 4,228,044, Cambre, issued Oct. 14, 1980.

Builder—The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) CH2(COOH) wherein R is $C_{10-20}$ alkyl or alkenyl, preferably $C_{12-16}$, or wherein R can be substituted with hydroxyl, sulfo sulfoxyl or sulfone substituents. Specfic examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Detergency builder salts are normally included in amounts of from 3% to 50% by weight of the composition preferably from 5% to 30% and most usually from 5% to 25% by weight.

Optional Detergent Ingredients:—Preferred detergent compositions of the present invention may further comprise one or more enzymes which provide cleaning performance and/or fabric care benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof.

A preferred combination is a detergent composition having a cocktail of conventional applicable enzymes like protease, amylase, lipase, cutinase and/or cellulase in conjunction with the lipolytic enzyme variant D96L at a level of from 50 LU to 8500 LU per liter wash solution.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of about 50KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Preferred commercially available protease enzymes include those sold under the tradenames Alcalase, Savinase, Primase, Durazym, and Esperase by Novo Nordisk A/S (Denmark), those sold under the tradename Maxatase, Maxacal and Maxapem by Gist-Brocades, those sold by Genencor International, and those sold under the tradename Opticlean and Optimase by Solvay Enzymes. Also proteases described in our co-pending application U.S. Ser. No. 08/136,797 can be included in the detergent composition of the invention. Protease enzyme may be incorporated into the compositions in accordance with the invention at a level of from 0.0001% to 2% active enzyme by weight of the composition.

A preferred protease herein referred to as "Protease D" is a carbonyl hydrolase variant having an amino acid sequence not found in nature, which is derived from a precursor carbonyl hydrolase by substituting a different amino acid for the amino acid residue at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the concurrently filed patent application of A. Baeck et al. entitled "Protease-Containing Cleaning Composition" having U.S. Ser. No. 08/322,676, filed Oct. 13, 1994, which is incorporated herein by reference in its entirety.

Highly preferred enzymes that can be included in the detergent compositions of the present invention include lipases. It has been found that the cleaning performance on greasy soils is synergistically improved by using lipases. Suitable lipase enzymes include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Highly preferred lipases are the D96L lipolytic enzyme variant of the native lipase derived from *Humicola lanuginosa* as described in U.S. Ser. No. 08/341,826. Preferably the *Humicola lanuginosa* strain DSM 4106 is used. This enzyme is incorporated into the composition in accordance with the invention at a level of from 50 LU to 8500 LU per liter wash solution. Preferably the variant D96L is present at a level of from 100 LU to 7500 LU per liter of wash solution. More preferably at a level of from 150 LU to 5000 LU per liter of wash solution.

By D96L lipolytic enzyme variant is meant the lipase variant as described in patent application WO 92/05249 viz. wherein the native lipase ex *Humicola lanuginosa* aspartic acid (D) residue at position 96 is changed to Leucine (L). According to this nomenclature said substitution of aspartic acid to Leucine in position 96 is shown as: D96L.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Amylases (& and/or β) can be included for removal of carbohydrate-based stains. Suitable amylases are Termamyl® (Novo Nordisk), Fungamyl® and BAN® (Novo Nordisk).

The above-mentioned enzymes may be of any suitable origin, such as vegetable, animal, bacterial, fungal and yeast origin.

Said enzymes are normally incorporated in the detergent composition at levels from 0.0001% to 2% of active enzyme by weight of the detergent composition. Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

Other components used in detergent compositions may be employed, such as soil-suspending agents, soil-release polymers, abrasives, bactericides, tarnish inhibitors, coloring agents, foam control agents, corrosion inhibitors and other perfumes.

Soil Release Agent—Any soil release agents known to those skilled in the art can be employed in the practice of this invention. Preferred polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Useful soil release polymers are described in U.S. Pat. No. 4,000,093, issued Dec. 28, 1976 to Nicol et al., European Patent Application 0 219 048, published Apr. 22, 1987 by Kud et al. U.S. Pat. No. 3,959,230 to Hays, issued May 25, 1976, U.S. Pat. No. 3,893,929 to Basadur issued Jul. 8, 1975, U.S. Pat. No. 4,702,857, issued Oct. 27, 1987 to Gosselink, U.S. Pat. No. 4,711,730, issued Dec. 8, 1987 to Gosselink et al., U.S. Pat. No. 4,721,580, issued Jan. 26, 1988 to Gosselink, U.S. Pat. No. 4,702,857, issued Oct. 27, 1987 to Gosselink, U.S. Pat. No. 4,877,896, issued Oct. 31, 1989 to Maldonado et al. All of these patents are incorporated herein by reference.

If utilized, soil release agents will generally comprise from about 0.01% to about 10.0%, by weight, of the detergent compositions herein, typically from about 0.1% to about 5%, preferably from about 0.2% to about 3.0%.

Chelating Agents—The detergent compositions herein may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

If utilized, these chelating agents will generally comprise from about 0.1% to about 10% by weight of the detergent compositions herein. More preferably chelating agents will comprise from about 0.1% to about 3.0% by weight of such compositions.

Clay Soil Removal/Anti-Redeposition Agent—The compositions of the present invention can also optionally contain water-soluble ethoxylated amines having clay soil removal and anti-redeposition properties. Liquid detergent compositions which contain these compounds typically contain from about 0.01% to 5%.

The most preferred soil release and anti-redeposition agent is ethoxylated tetraethylenepentamine. Exemplary ethoxylated amnines are further described in U.S. Pat. No. 4,597,898, VanderMeer, issued Jul. 1, 1986, incorporated herein by reference. Another group of preferred clay soil removal/anti-redeposition agents are the cationic compounds disclosed in European Patent Application 111,965, Oh and Gosselink, published Jun. 27, 1984, incorporated herein by reference. Other clay soil removal/anti-redeposition agents which can be used include the ethoxylated amine polymers disclosed in European Patent Application 111,984, Gosselink published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated herein by reference.

Other clay soil removal and/or anti redeposition agents known in the art can also be utilized in the compositions hereof. Another type of preferred anti-redeposition agent includes the carboxymethylcellulose (CMC) materials.

Polymeric Dispersing Agents—Polymeric dispersing agents can advantageously be utilized in the compositions hereof. These materials can aid in calcium and magnesium hardness control. Suitable polymeric dispersing agents include polymeric polycarboxylates and polyethylene glycols, although others known in the art can also be used. The compositions hereof will generally comprise from 0% to about 5% of polymeric dispersing agent.

Suitable polymeric dispersing agents for use herein are described in U.S. Pat. No. 3,308,067, Diehl, issued Mar. 7, 1967, and European Patent Application No. 66915, published Dec. 15, 1982, both incorporated herein by reference.

Brightener—Any suitable optical brighteners or other brightening or whitening agents known in the art can be incorporated into the detergent compositions hereof. The compositions hereof will generally comprise from 0% to about 5% of brightener Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982), the disclosure of which is incorporated herein by reference.

Suds Suppressor—Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS 2,124,526, U.S. Pat. No. 3,933,672, Bartolotta et al., and U.S. Pat. No. 4,652,392, Baginski et al., issued Mar. 24, 1987. All are incorporated herein by reference.

The compositions hereof will generally comprise from 0% to about 5% of suds suppressor.

Other Ingredients—The compositions herein may also contain other perfume ingredients such as aldehydes, ketones, alcohols and esters. They have been described by Parry in Parry's *Cyclopedia of Perfumary* (1925) Vol. I and II published by P. Blakiston's Son & Co.; and also by Bedoukian in *Perfumary and Flavoring Synthetics* (1967), published by Elsevier Publishing Company.

A wide variety of other ingredients useful in detergent compositions can be included in the compositions hereof, including other active ingredients, carriers, hydrotropes, processing aids, dyes or pigments, solvents for liquid formulations, bleaches, bleach activators, enzyme stabilizing systems, etc.

Liquid Compositions—The laundry detergent compositions herein preferably have a pH in a 10% solution in water at 20° C. of between about 5 and about 12, more preferably between about 8 and about 12 for granular compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

Preferred liquid laundry detergent compositions hereof will preferably be formulated such that during use in aqueous cleaning operations, the wash water will have a pH of between about 6.5 and 11.0, preferably between about 7.0 and 8.5, The liquid detergent compositions herein preferably have a pH in a 10% solution in water at 20° C. of between about 6.5 and 11.0, preferably 7.0 to 8.5. Techniques for controlling pH at recommended usage levels include the use of buffers, alkalis, acids, etc., and are well known to those skilled in the art.

Preferably, the liquid compositions according to the present invention are in "concentrated form"; in such case, the liquid detergent compositions according to the present invention will contain a lower amount of water, compared to conventional liquid detergents. The level of water is less than 50%, preferably less than 30% by weight of the detergent compositons.

Said concentrated products provide advantages to the consumer, who has a product which can be used in lower amounts and to the producer, who has lower shipping costs.

The liquid compositions are especially effective when applied directly to soils and stains in a pretreatment step.

The detergent compositions of the present invention can also be used as detergent additive products. Such additive products are intended to supplement or boost the performance of conventional detergent compositions.

The detergent compositions according to the present invention include compositions which are to be used for cleaning of substrates, such as fabrics, fibers, hard surfaces, skin etc., for example hard surface cleaning compositions (with or without abrasives), laundry detergent compositions, automatic and non-automatic dishwashing compositions.

The following examples illustrate the compositions of the present invention. All parts, percentages and ratios used herein are by weight unless otherwise specified.

EXAMPLE I

A "fresh citrus" perfume is prepared using the following components:

| PERFUME A | % BY WEIGHT |
|---|---|
| Alpha terpineol | 1.80 |
| Citronellol | 1.50 |
| Citronellyl acetate | 1.08 |
| Geraniol | 1.26 |
| Isobornyl acetate | 1.08 |
| Linalool | 1.44 |
| Linalyl acetate | 2.10 |
| Camphene | 0.78 |
| Fenchyl acetate | 0.12 |
| Alpha pinene | 1.50 |
| Beta pinene | 1.08 |
| Citral | 2.40 |
| Citrathal | 0.74 |
| Citronellal nitrile | 0.84 |
| Dihydromyrcenol | 0.60 |
| Dipentene | 3.00 |
| Geranyl nitrile | 0.60 |
| Lemon oil | 0.30 |
| Orange oil 2× rectified | 2.40 |
| p-Cymene | 1.26 |
| Pseudo linalyl acetate | 1.20 |
| dodecahydro-3a,6,6,9A-tetramethylnaphtho (2,1-B) furan | 5.00 |
| Other perfume components | 72.74 |
| | 100.00 |

This perfume is then useful in detergent compositions, particularly when amine surfactants are present. The perfume can be used at a level of from about 0.01% to about 1%, by weight of the detergent composition.

The dodecahydro-3*a*,6,6,9A-tetramethylnaphtho (2,1-B) furan is substituted with an equal amount of one or more of the following perfume components: 3,3-dimethyl-5-(2,2,3 trimethyl-3 cyclopenten-1-yl)-4 pentenol, methyl ionone, cis 3 hexenyl iso butyrate, undecalactone, phenyl ethyl phenyl acetate, hexyl-ortho-hydroxybenzoate, and mixtures thereof.

EXAMPLE II

A "fresh" perfume is prepared using the following components:

| PERFUME B | % BY WEIGHT |
|---|---|
| IFF-917* | 92.00 |
| Dodecahydro-3a,6,6,9A-tetramethylnaphtho (2,1-B) furan | 0.30 |

-continued

| PERFUME B | % BY WEIGHT |
|---|---|
| 3,3-dimethyl-5-(2,2,3 trimethyl-3 cyclopenten-1-yl)-4 pentenol | 0.15 |
| Methyl ionone | 1.55 |
| Cis 3 hexenyl iso butyrate | 0.25 |
| Undecalactone | 0.30 |
| Phenyl ethyl phenyl acetate | 1.15 |
| Hexyl-ortho-hydroxybenzoate | 4.30 |
| | 100.00 |

*Supplied by International Flavor and Fragrance Company of New Jersey

This perfume is then useful in detergent compositions, particularly when amine surfactants are present. The perfume can be used at a level of from about 0.01% to about 1%, by weight of the detergent composition.

EXAMPLE III–VIII

The following liquid detergent compositions are made:

| Ingredient | Example III Wt % | Example IV Wt % |
|---|---|---|
| Sodium C12–15alkyl polyethoxylate (2.5) sulfate | 13.50 | 13.70 |
| Sodium 12–15 alkyl sulfate | 4.50 | 4.00 |
| Ethanol | 3.50 | 2.64 |
| Monoethanolamine | 1.00 | 0.75 |
| C10 amidopropyldimethyl amine | 1.75 | 1.3 |
| Propandiol | 7.50 | 7.50 |
| C12–13 Alkyl polyethoxylate (9) | 2.00 | 0.63 |
| C12–l4 alkyl glucose amide | 4.50 | 3.35 |
| C12–14 fatty acid | 2.00 | 3.50 |
| Sodium toluene sulfonate | 2.50 | 2.25 |
| Citric acid | 3.00 | 2.65 |
| PERFUME A | 0.01 | 1.00 |
| Enzymes | 0.05 | 0.05 |
| Borax | 3.50 | 3.50 |
| Sodium hydroxide (to pH 8.0) | 2.95 to pH = 8.0 | 2.10 to pH = 7.6 |
| Tetraethylenepentamine ethoxylated (15–18) | 1.18 | 1.18 |
| Water | to 100% | to 100% |

Perfume A may be substituted with an equal amount of Perfume B.

The $C_{10}$ amidopropyldimethyl amine is substituted with an equal amount of the following amines: octyl amine, hexyl amine, decyl amine, dodecyl amine, $C_8$–$C_{12}$ bis (hydroxyethyl)amine, $C_8$–$C_{12}$ bis(hydroxyisopropyl)amine, and $C_8$, $C_9$, $C_{11}$ or $C_{12}$ amido-propyl dimethyl amine, and mixtures.

The following enzymes are used: protease, lipase, amylase, cellulase, peroxidase, and mixtures thereof.

| Ingredient | Example V Wt % |
|---|---|
| Sodium C12–15alkyl polyethoxylate (2.5) sulfate | 9.40 |
| Sodium 12–15 alkyl sulfate | 3.10 |
| Ethanol | 2.18 |
| Monoethanolamine | 1.00 |
| C10 amidopropyldimethyl amine surfactant | 4.30 |
| Propandiol | 3.20 |
| C12–13Alkyl polyethoxylate (9) | 1.00 |
| C12–14 alkyl glucose amide | 2.00 |
| C12–14 fatty acid | 1.00 |
| Sodium toluene sulfonate | 2.25 |
| Citric acid | 1.80 |

-continued

| Ingredient | Example V Wt % |
|---|---|
| PERFUME A | 0.5 |
| Enzymes | 0.05 |
| Borax | — |
| Sodium hydroxide (to pH 8.0) | 2.07 to pH = 8.0 |
| Tetraethylenepentamine ethoxylated (15–18) | 1.00 |
| Water | to 100% |

The $C_{10}$ amnidopropyldimethyl amine is substituted with an equal amount of the following amines: octyl amine, hexyl amine, decyl amine, dodecyl amine, $C_8$–$C_{12}$ bis (hydroxyethyl)amine, $C_8$–$C_{12}$ bis(hydroxyisopropyl)amine, and $C_8$, $C_9$, $C_{11}$ or $C_{12}$ amido-propyl dimethyl amine, and mixtures.

The following enzymes are used: protease, lipase, amylase, cellulase, peroxidase, and mixtures thereof.

Perfume A may be substituted with an equal amount of Perfume B.

| Ingredient | Example VI Wt % | Example VII Wt % |
|---|---|---|
| Sodium C12–15alkyl polyethoxylate (3) sulfate | 13.70 | 13.70 |
| Sodium 12–15 alkyl sulfate | 4.00 | 4.00 |
| Ethanol | 2.64 | 2.64 |
| Monoethanolamine | 0.75 | 0.75 |
| Octyl amine | 3.0 | — |
| C12 amidopropyldimethyl amine | — | 0.5 |
| Propandiol | 7.50 | 7.50 |
| C12–13Alkyl polyethoxylate (9) | 0.63 | 0.63 |
| C12–14 alkyl glucose amide | 3.35 | 3.35 |
| C12–16 fatty acid | 3.50 | 3.50 |
| Sodium toluene sulfonate | 2.25 | 2.25 |
| Citric acid | 2.65 | 2.65 |
| PERFUME A | 0.25 | 0.05 |
| Enzyme | 0.1 | 0.075 |
| Borax | 3.50 | 3.50 |
| Sodium hydroxide | 2.1 to pH = 7.6 | 2.1 to pH = 7.6 |
| Tetraethylenepentamine ethoxylated (15–18) | 1.18 | 1.18 |
| Water, & other optional ingredients | to 100% | to 100% |

Perfume A may be substituted with an equal amount of Perfume B.

The amines are substituted with an equal amount of the following amines: hexyl amine, decyl amine, dodecyl amine, $C_8$–$C_{12}$ bis(hydroxyethyl)amine, $C_8$–$C_{12}$ bis (hydroxyisopropyl)amine, and $C_{8-11}$ amido-propyl dimethyl amine, and mixtures.

The following enzymes are used: protease, lipase, amylase, cellulase, peroxidase, and mixtures thereof.

| Ingredient | Example VIII Wt % |
|---|---|
| Sodium C12–15alkyl polyethoxylate (3) sulfate | 13.70 |
| Sodium 12–15 alkyl sulfate | 4.00 |
| Ethanol | 2.64 |
| Monoethanolamine | 0.75 |
| Octyl amine | — |
| C12 bis (hydroxyethyl) amine | 2.0 |
| Propandiol | 7.50 |
| C12–13Alkyl polyethoxylate (9) | 0.63 |
| C12–14 alkyl glucose amide | 3.35 |
| C12–16 fatty acid | 3.50 |
| Sodium toluene sulfonate | 2.25 |

-continued

| Ingredient | Example VIII Wt % |
|---|---|
| Citric acid | 2.65 |
| PERFUME B | 0.75 |
| Enzyme | 0.25 |
| Borax | 3.50 |
| Sodium hydroxide | 2.1 to pH = 7.6 |
| Tetraethylenepentamine ethoxylated (15–18) | 1.18 |
| Water, & other optional ingredients | to 100% |

Perfume B may be substituted with an equal amount of Perfume A.

The $C_{12}$ bis (hydroxyethyl) amine is substituted with an equal amount of the following amines: octyl amine, hexyl amine, decyl amine, dodecyl amine, $C_8$–$C_{11}$ bis (hydroxyethyl)amine, $C_8$–$C_{12}$ bis(hydroxyisopropyl)amine, and $C_{8-12}$ amido-propyl dimethyl amine, and mixtures.

The following enzymes are used: protease, lipase, amylase, cellulase, peroxidase, and mixtures thereof.

All detergent compositions in the above examples have a significantly reduced amine malodor as compared to equal formulations which do not contain the perfume components included above.

What is claimed is:

1. A laundry detergent composition comprising:

(a) from about 0.05% to about 10%, by weight of detergent composition of an amine detersive surfactant of the formula: $R_1$—X—$(CH_2)_n$—$N(R_3)(R_4)$wherein $R_1$ is a $C_{6-12}$ alkyl group; n is from about 2 to about 4, X is a bridging group selected from the group consisting of NH, CONH, COO, or O; or X can be absent; and $R_3$ and $R_4$ are individually selected from H, $C_{1-4}$ alkyl, or ($CH_2$—CH(OH)—$R_5$) wherein $R_5$ is H or methyl;

(b) from about 0.00001% to about 5%, by weight of the composition, of a perfume component selected from the group consisting of dodecahydro-3*a*, 6,6,9A-tetramethylnaphtho (2,1-B) furan, 3,3-dimethyl-5-(2, 2,3 trimethyl-3 cyclopenten-1-yl)-4 pentenol, methyl ionone, cis 3 hexenyl iso butyrate, undecalactone, phenyl ethyl phenyl acetate, hexyl-ortho-hydroxybenzoate, and mixtures thereof; and (c) from about 1 to about 95%, by weight of the composition, of other non-amine detersive surfactants selected from anionic, nonionic, ampholytic, cationic, zwitterionic, and mixtures thereof.

2. A composition according to claim 1 further comprising a performance eahancing amount of a detergent-compatible enzyme selected from the group consisting of protease, lipase, amylase, cellulase, peroxidase, and mixtures thereof.

3. A liquid detergent composition acording to claim 1 wherein said amine is selected from the following:

$$R_1—(CH_2)_2—NH_2$$

$$R_1—O—(CH_2)_3—NH_2$$

$$R_1—C(O)—NH—(CH_2)_3—N(CH_3)_2$$

$$R_1—N(CH_2—CH(OH)—R_5)_2$$

wherein R1 is a C6–C12 alkyl group and R5 is H or $CH_3$.

4. A liquid detergent composition according to claim 3 wherein said amine is selected from the following:

$$R_1—C(O)—NH—(CH_2)_3—N(CH_3)_2$$

wherein $R_1$ is $C_8$–$C_{12}$ alkyl.

5. A liquid detergent composition according to claim 3 wherein said amine is selected from the group consisting of octyl amine, decyl amine, dodecyl amine, $C_8$–$C_{12}$ bis (hydroxyethyl)amine; $C_8$–$C_{12}$ bis(hydroxyisopropyl)amine, and $C_8$–$C_{12}$ amido-propyl dimethyl amine, and mixtures.

6. A liquid detergent composition according to claim 5 further comprising builders and other conventional detergent ingredients.

7. A detergent composition according to claim 1 wherein said perfume component reduces the malodor of said amine surfactant.

* * * * *

UNITED STATES PATENT AND TRADEMARK OFFICE

CERTIFICATE OF CORRECTION

PATENT NO. : 5,929,022

DATED : July 27, 1999

INVENTOR(S) : Jose Maria Velazquez

It is certified that error appears in the above-identified patent and that said Letters Patent is hereby corrected as shown below:

ON THE TITLE PAGE:

Item [56] References Cited, US Patent Documents, please add

| | | | |
|---|---|---|---|
| 5,856,290 | 01/05/99 | Van Buskirk et al. | 510/382 |
| 4,507,219 | 03/26/85 | Hughes | 252/118 |
| 4,142,999 | 03/06/79 | Bloching et al. | 252/544 |
| 4,970,028 | 11/13/90 | Kenyon et al. | 252/544 |
| 4,648,979 | 03/10/87 | Parslow et al. | 252/8.8 |
| 5,336,426 | 08/09/94 | Rader et al. | 252/102 |
| 4,594,184 | 06/10/86 | Cook et al. | 252/542 |
| 5,077,040 | 12/31/91 | Bergmann et al. | 424/70 |
| 4,301,022 | 11/17/81 | Sprecker et al. | 252/174.11 |
| 4,853,146 | 08/01/89 | Rorig et al. | 252/142 |

UNITED STATES PATENT AND TRADEMARK OFFICE

CERTIFICATE OF CORRECTION

PATENT NO. : 5,929,022

DATED : July 27, 1999

INVENTOR(S) : Jose Maria Velazquez

It is certified that error appears in the above-identified patent and that said Letters Patent is hereby corrected as shown below:

After "FOREIGN PAENT DOCUMENTS" please add:
--203660 12/1986 European Pat. Off. --.

Signed and Sealed this

Eighteenth Day of April, 2000

*Attest:*

Q. TODD DICKINSON

*Attesting Officer*

*Director of Patents and Trademarks*